US011787036B1

(12) United States Patent
Shrock

(10) Patent No.: US 11,787,036 B1
(45) Date of Patent: Oct. 17, 2023

(54) OVERHEAD CREEPER

(71) Applicant: John Shrock, Niangua, MO (US)

(72) Inventor: John Shrock, Niangua, MO (US)

( * ) Notice: Subject to any disclaimer, the term of this patent is extended or adjusted under 35 U.S.C. 154(b) by 0 days.

(21) Appl. No.: 17/217,833

(22) Filed: Mar. 30, 2021

Related U.S. Application Data

(63) Continuation of application No. 16/356,907, filed on Mar. 18, 2019, now abandoned, which is a continuation of application No. 29/582,831, filed on Oct. 31, 2016, now Pat. No. Des. 843,675.

(51) Int. Cl.
*B25H 5/00* (2006.01)

(52) U.S. Cl.
CPC ..... *B25H 5/00* (2013.01)

(58) Field of Classification Search
CPC ..... B25H 5/00; A47C 9/025
See application file for complete search history.

(56) References Cited

U.S. PATENT DOCUMENTS 2,701,168 A * 2/1955 Schemers ..... B62B 3/10 182/116
2,872,252 A * 2/1959 Konkle ..... B25H 5/00 108/147.21
2,969,123 A * 1/1961 Jamerson ..... B25H 5/00 182/116
2,970,668 A * 2/1961 Snyder ..... B25H 5/00 182/116
4,072,209 A * 2/1978 Bolis ..... B25H 5/00 182/116
4,397,374 A * 8/1983 Rumage ..... B25H 5/00 182/129
4,530,419 A * 7/1985 Rumage ..... B25H 5/00 182/106
4,542,806 A * 9/1985 Olson ..... B25H 5/00 182/116
5,899,297 A * 5/1999 Clark ..... B25H 5/00 182/222
D412,045 S 7/1999 Yuan
6,105,719 A * 8/2000 Lensing ..... E06C 1/397 182/116
6,199,877 B1 3/2001 Shockley
D453,601 S 2/2002 Ji
6,540,301 B1 4/2003 Bottoms
6,595,590 B2 * 7/2003 Bottoms ..... A47C 9/025 135/66
6,641,146 B2 * 11/2003 Reese ..... B25H 5/00 182/116
6,834,868 B1 12/2004 Blackburn
6,957,718 B1 * 10/2005 Whiteside ..... B25H 5/00 182/115

(Continued)

OTHER PUBLICATIONS

"Final Office Action Received for U.S. Appl. No. 16/356,907 , dated Sep. 30, 2020."

(Continued)

*Primary Examiner* — Bryan A Evans
(74) *Attorney, Agent, or Firm* — Kutak Rock LLP

(57) ABSTRACT

A method and apparatus for supporting a user over an automotive engine is provided. The apparatus includes a base, a ladder and a platform. In some embodiment, leg stirrups extend from said base to support the user's legs while working over an automotive engine.

6 Claims, 7 Drawing Sheets

(56) References Cited

U.S. PATENT DOCUMENTS

| | | | | |
|---|---|---|---|---|
| 7,070,189 | B2 * | 7/2006 | Grauss | B25H 5/00 108/147 |
| 7,080,715 | B1 * | 7/2006 | Bowlin | B25H 5/00 182/116 |
| D555,920 | S | 11/2007 | Whiteside et al. | |
| D579,679 | S | 11/2008 | Qian et al. | |
| 7,481,438 | B2 | 1/2009 | Hernandez | |
| D608,072 | S | 1/2010 | Hernandez | |
| 7,686,310 | B2 * | 3/2010 | Perkins | B25H 1/0007 280/32.5 |
| 8,151,937 | B2 * | 4/2012 | Blemel | A47C 16/04 182/115 |
| D707,914 | S | 6/2014 | Ward | |
| D808,673 | S | 1/2018 | Brewer et al. | |
| D843,675 | S | 3/2019 | Shrock | |
| 2003/0098559 | A1 * | 5/2003 | Reese | B25H 5/00 280/32.6 |
| 2007/0241523 | A1 * | 10/2007 | Lewman | B25H 5/00 280/32.5 |
| 2012/0325584 | A1 | 12/2012 | Podzimek | |
| 2019/0210214 | A1 | 7/2019 | Shrock | |

OTHER PUBLICATIONS

"Nomad Manufacturing website address: http://www.nomadmfg.com/the-elevator/ (Last accessed Nov. 4, 2016)".

"Nomad Manufacturing website address: http://www.nomadmfg.com/the-fold-away/ (Last accessed Nov. 4, 2016)".

"Non-Final Office Action received for U.S. Appl. No. 16/356,907, dated Jul. 11, 2019."

"Non-Final Office Action received for U.S. Appl. No. 29/582,831, dated Mar. 5, 2018."

"Notice of Allowance Received for U.S. Appl. No. 29/582,831, dated Oct. 24, 2018, 8 pages".

"The Redline Engineering Store website address: http://www.redlinestands.com/catalog/automotive-creepers-stools-c-327_328_274/elevator-overthetop-topside-truck-creeper-p-2195?gclid=CN7yonwh84CFQKTaQodpBUEpQ (Last accessed Nov. 4, 2016)".

"The Redline Engineering Store website address: http://www.redlinestands.com/catalog/shop-equipment-c-327/automotive-c-327_328/creepers-amp-stools-c-327_328_274/whiteside-gooseneck-over-engine-creeper-p-2419 (Last accessed Nov. 4, 2016)".

"The Redline Engineering Store website address: http://www.redlinestands.com/catalog/shop-equipment-c-327/automotive-c-327_328/creepers-amp-stools-c-327_328_274/redline-engineering-top-side-overhead-creeper-p-1506 (Last accessed Nov. 4, 2016)".

* cited by examiner

OVERHEAD CREEPER

CROSS-REFERENCE TO RELATED APPLICATIONS

This application is a continuation application of U.S. patent application Ser. No. 16/356,907, filed Mar. 17, 2019, which is a continuation application of U.S. Design patent application Ser. No. 29/582,831, filed Oct. 31, 2016, now U.S. Pat. No. D843,675, the entire disclosures of which are incorporated herein by reference.

FIELD OF THE INVENTION

The present invention relates automotive equipment. More specifically, the present invention is concerned with a method and an apparatus to perform service on automotive engines (such as large truck engines) from above.

BACKGROUND OF THE INVENTION

Working on automotive engines is labor intensive work. Especially when working on large truck engines, reaching the area to work on is difficult, and often requires a ladder or other method to reach due to the height of the engine. Overhead creeper devices are often used to suspend a worker over the top of the engine. Nevertheless, conventional creepers place a user's body in a position that provides significant strain on the back.

Therefore, it would be beneficial to provide a system, method and/or apparatus for supporting a user over the top of an automotive engine that provides support for the user's back and/or legs.

SUMMARY OF THE INVENTION

The present invention comprises an overhead creeper that includes a top platform that in some embodiments is removably attached to the base of the creeper. The top platform includes in some embodiments four casters at its corners to allow the top platform to function as a low profile creeper when removed from the base. The top platform in some embodiments also includes a padded chin/head rest removably and adjustably attached to the front of the top platform to support a user's head and/or chin while using the creeper. The chin/head rest of some embodiments is adjustable pivotally as well as inward and outward of the top platform to accommodate varying user sizes and comfort preferences. The central area of the top platform in some embodiments is padded for comfort during use, and in some embodiments bins extend along the sides of the central area for storage of tools, parts and other objects during use of the creeper. A pair of stirrups are rotatably mounted at the top of the base of some embodiments, adjacent to the back side of the top platform. The stirrups are rotatable inward for supporting the user's legs when using the overhead creeper, and outward to allow the user to easily climb on and off the top platform. In some embodiments, each stirrup includes an adjustable padded leg support that slides along a leg member of the stirrup that attaches connects the leg support to the base. In some embodiments, locking roller casters are positioned at the bottom of the base to allow the overhead creeper to be easily moved to and from the work area and to lock and prevent the creeper from rolling while in use. In some embodiments, the base includes lower leg members that include locking roller casters and the lower leg members pivot upward to a storage position and downward to an extended position. In the embodiment shown in FIG. 1, cotter pins extend through the lower leg members to lock the legs into the extended position for use of the overhead creeper. The base of some embodiments further includes a storage tray positioned between the lower leg members and an extendable ladder. The ladder in some embodiments extends up and down telescopically and is locked into position by locking pins and/or cotter pins. In some embodiments, an adjustable step slides up and down the top portion of the ladder and is held into a user-desired position by cotter pins and/or other locking pins. In preferred embodiments, the frame of the overhead creeper is made of carbon steel and/or aircraft aluminum.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
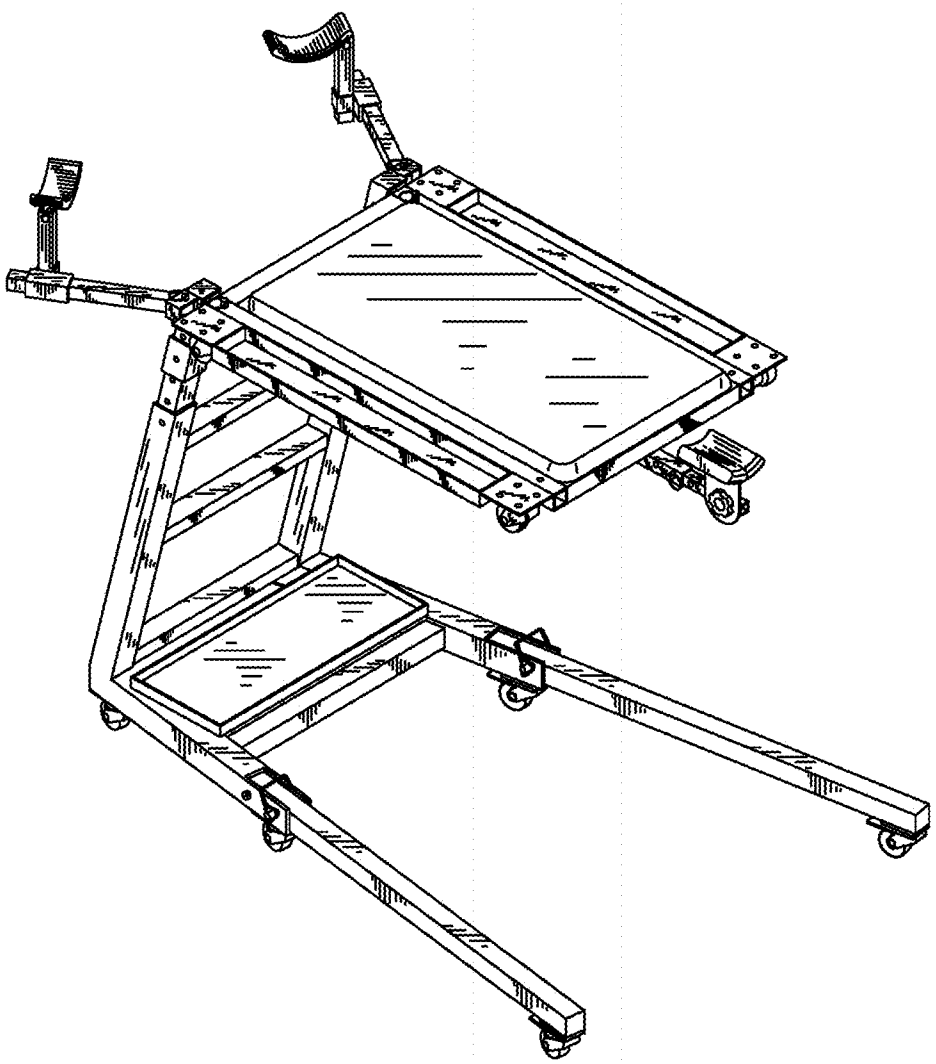
FIG. 1 is a front left side perspective view of an embodiment of an overhead creeper of the inventive concept.

Referring to FIG. 1, a preferred embodiment of the apparatus includes a top platform that is removably attached to the base of the creeper. The top platform includes four casters at its corners to allow the top platform to function as a low profile creeper when removed from the base. The top platform also includes a padded chin/head rest removably and adjustably attached to the front of the top platform to support a user's head and/or chin while using the creeper. The chin/head rest is adjustable pivotally as well as inward and outward of the top platform to accommodate varying user sizes and comfort preferences. The central area of the top platform is padded for comfort during use, and bins extend along the sides of the central area for storage of tools, parts and other objects during use of the creeper. A pair of stirrups are rotatably mounted at the top of the base adjacent to the back side of the top platform. The stirrups are rotatable inward for supporting the user's legs when using the overhead creeper, and outward to allow the user to easily climb on and off the top platform. Each stirrup includes an adjustable padded leg support that slides along a leg member of the stirrup that attaches connects the leg support to the base. Locking roller casters are positioned at the bottom of the base to allow the overhead creeper to be easily moved to and from the work area and to lock and prevent the creeper from rolling while in use. The base includes lower leg members that include locking roller casters and the lower leg members pivot upward to a storage position and downward to an extended position. In the embodiment shown in FIG. 1, cotter pins extend through the lower leg members to lock the legs into the extended position for use of the overhead creeper. The base further includes a storage tray positioned between the lower leg members and an extendable ladder. The ladder extends up and down telescopically and is locked into position by locking pins and/or cotter pins. An adjustable step slides up and down the top portion of the ladder and is held into a user-desired position by cotter pins and/or other locking pins. In preferred embodiments, the frame of the overhead creeper is made of carbon steel and/or aircraft aluminum.

Figure 2:
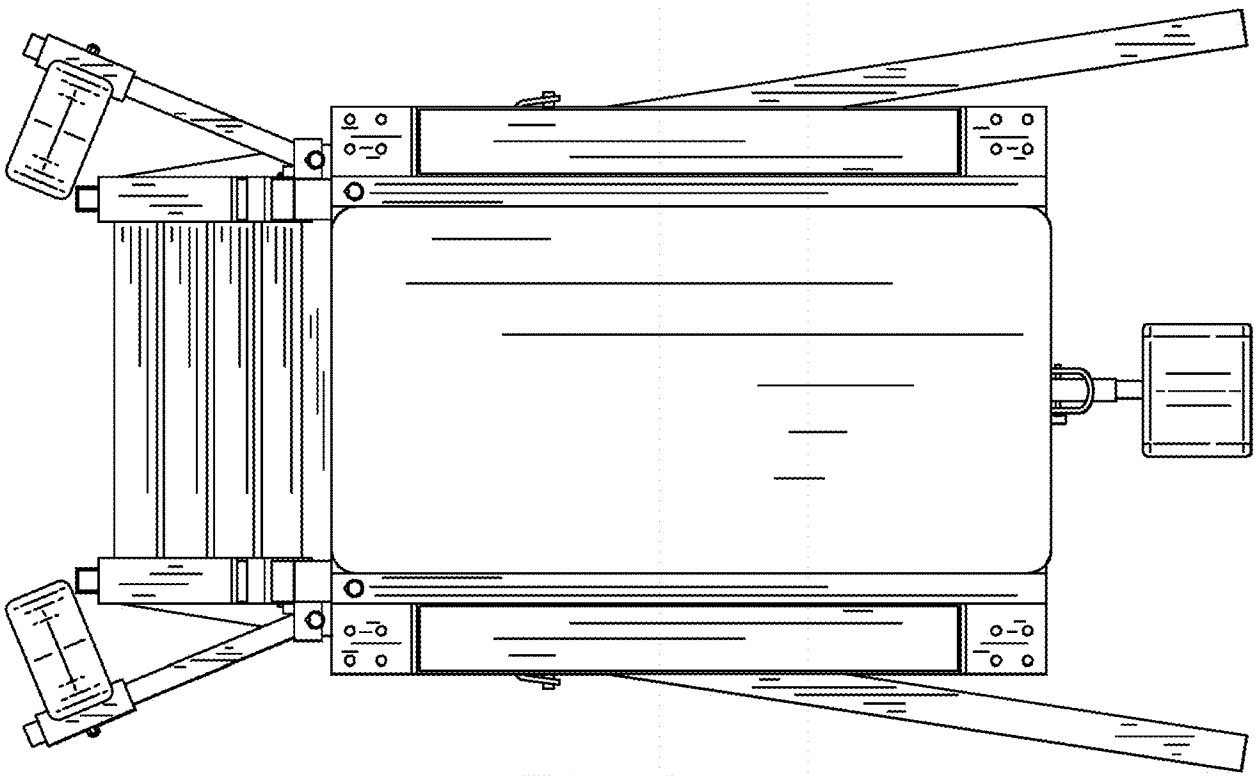
FIG. 2 is a top plan view of the overhead creeper of FIG. 1.

FIG. 2 is a top plan view of the overhead creeper of FIG. 1.

Figure 3:
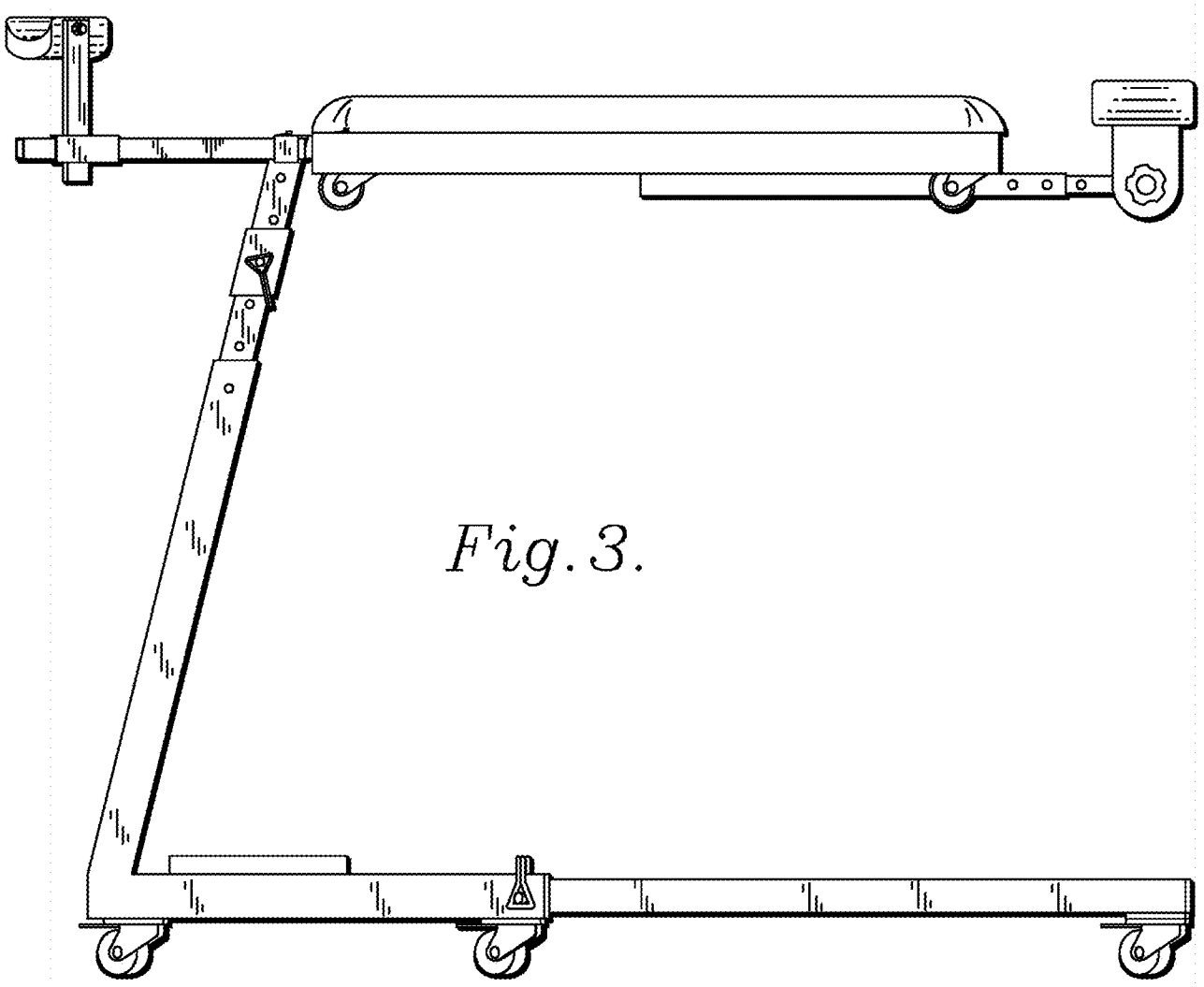
FIG. 3 is a left side elevation view of the overhead creeper of FIG. 1.

FIG. 3 is a left side elevation view of the overhead creeper of FIG. 1.

Figure 4:
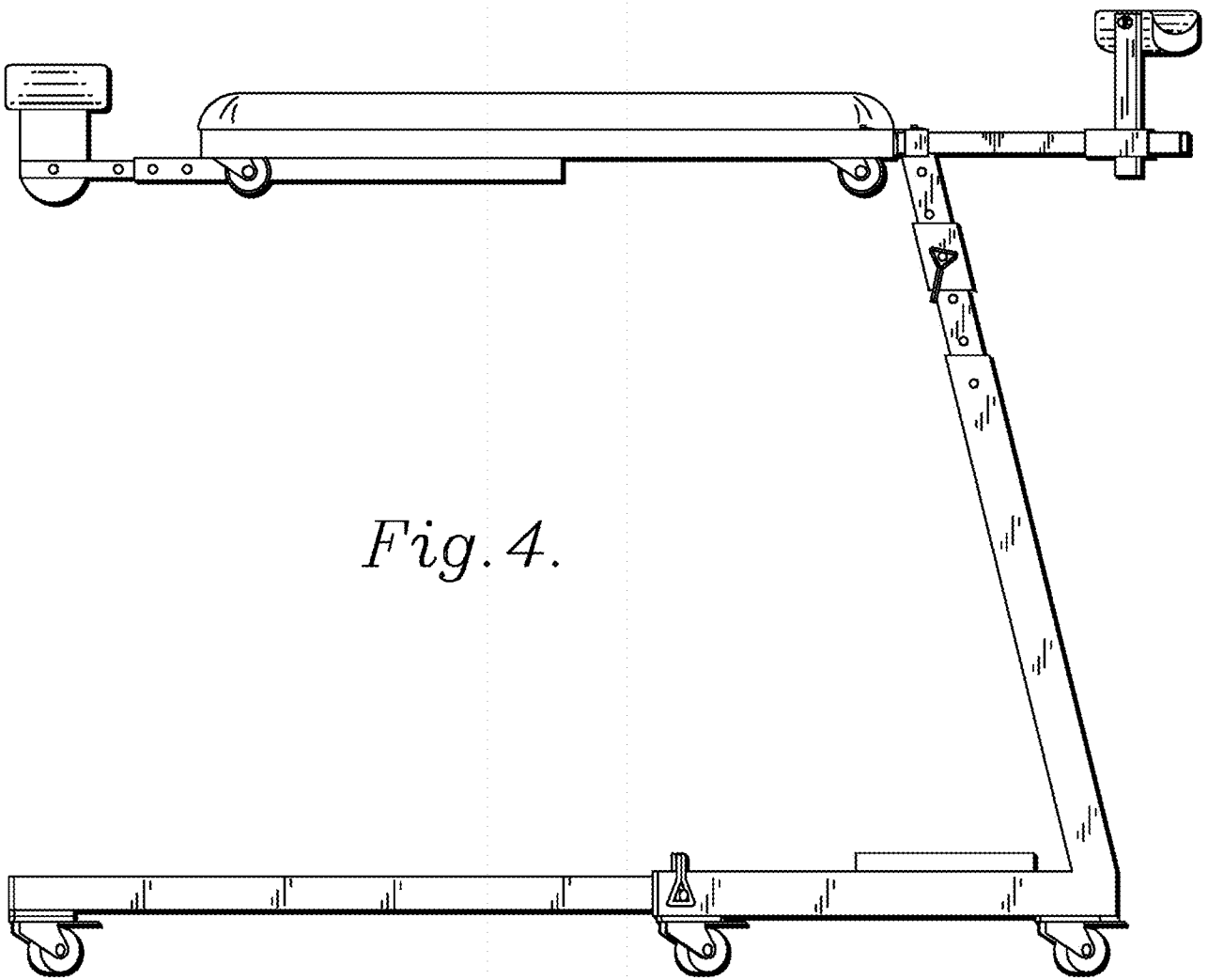
FIG. 4 is a right side elevation view of the overhead creeper of FIG. 1.

FIG. 4 is a right side elevation view of the overhead creeper of FIG. 1.

Figure 5:
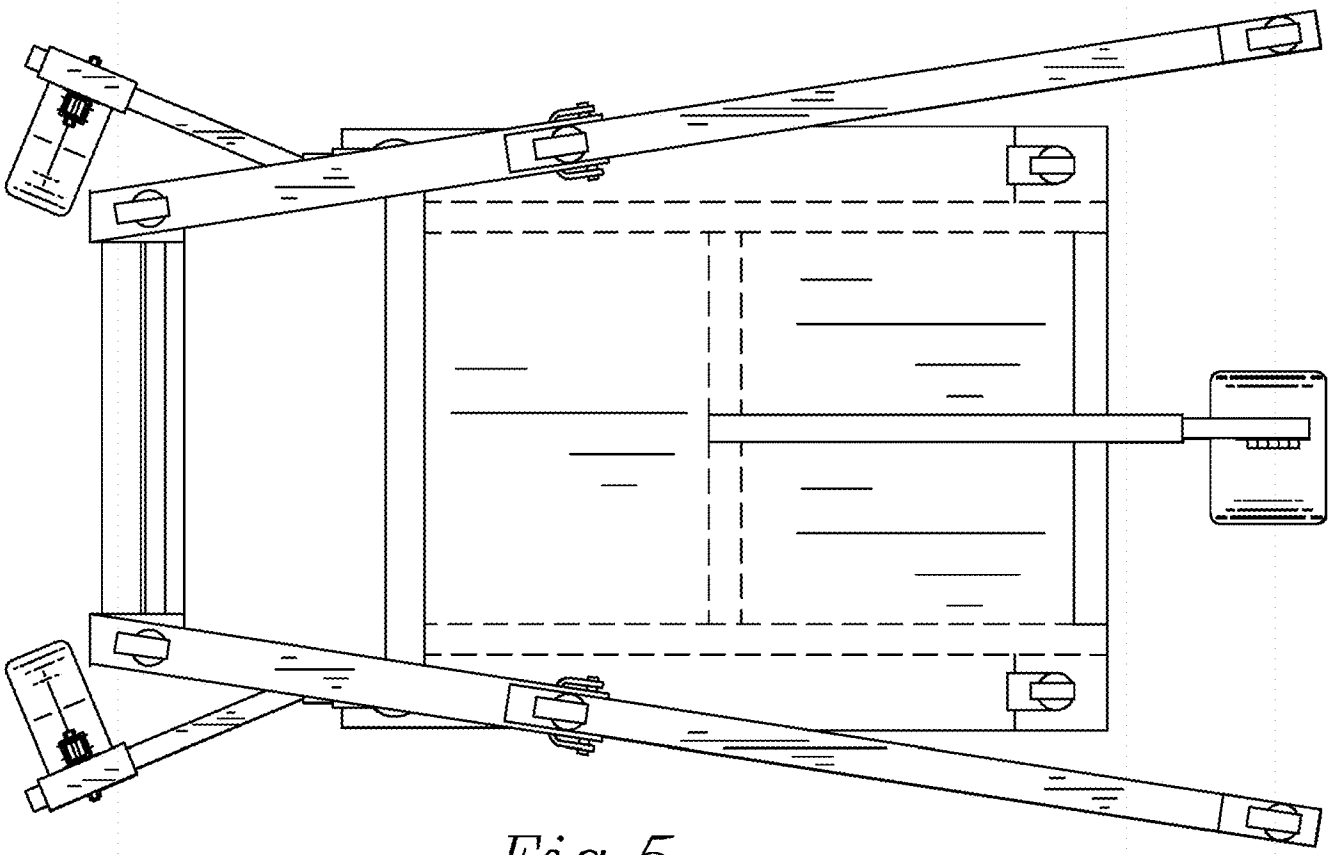
FIG. 5 is a bottom plan view of the overhead creeper of FIG. 1.

FIG. 5 is a bottom plan view of the overhead creeper of FIG. 1.

Figure 6:
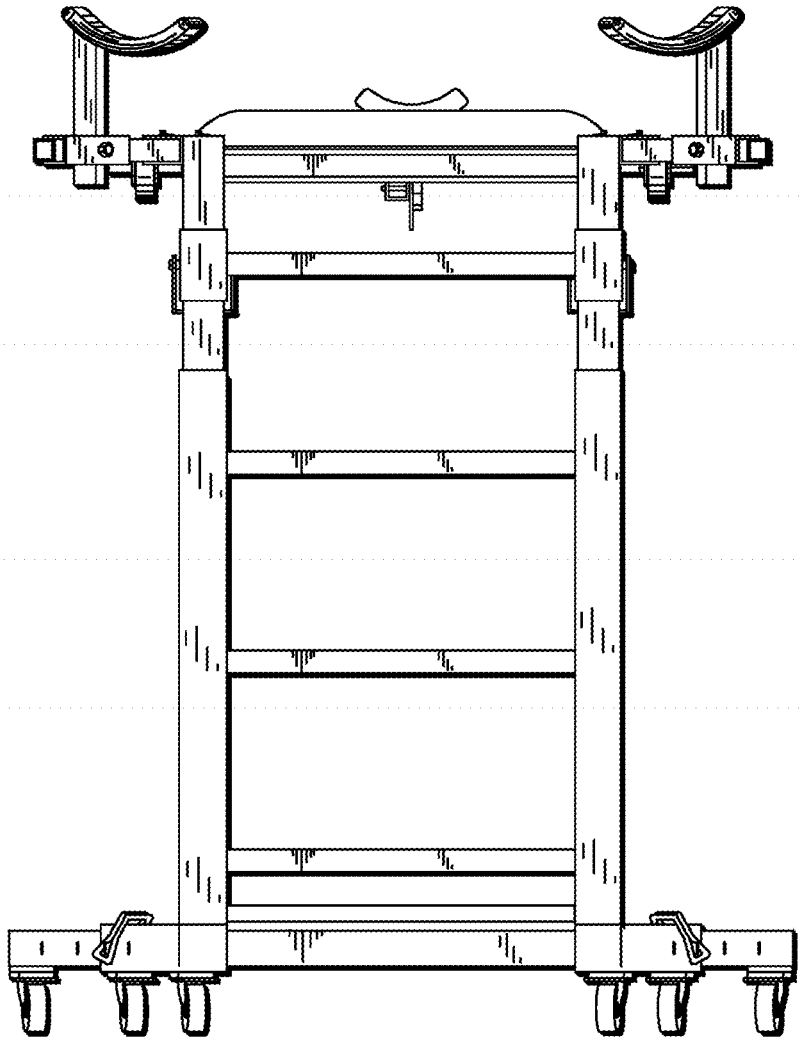
FIG. 6 is a rear elevation view of the overhead creeper of FIG. 1

FIG. 6 is a rear elevation view of the overhead creeper of FIG. 1

Figure 7:
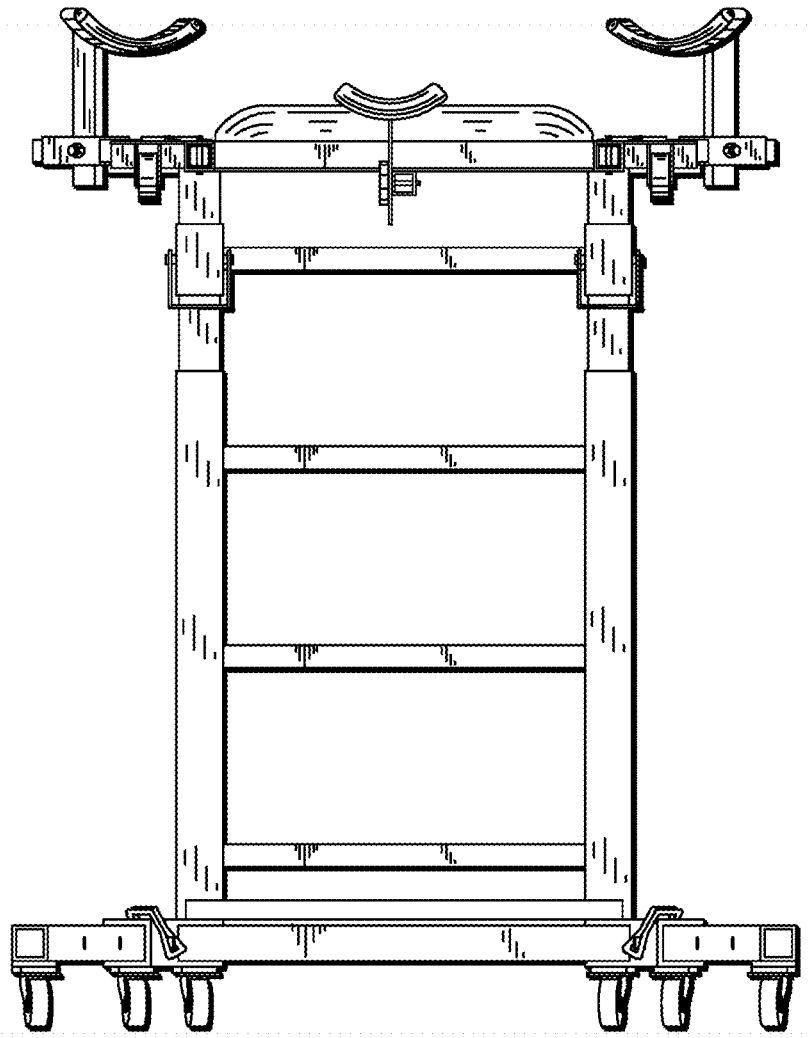
FIG. 7 is a front elevation view of the overhead creeper of FIG. 1.

FIG. 7 is a front elevation view of the overhead creeper of FIG. 1.

In some embodiments of the overhead creeper of FIG. 1 the top platform is removed and located in a stowed position resting on the base, and the lower leg members are pivoted upward to retain the top platform in position. In some such embodiments the lower leg members are held into the stowed position via cotter pins and/or other locking pins.

In some embodiments the stirrups are removed from the top of the base and stowed in the storage tray of the base.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. An overhead creeper comprising a base;

a platform removably attached to said base;

a ladder extending from said base to said platform; and stirrups extending from said base at a location adjacent to said platform;

wherein said stirrups are rotatably mounted to said base and rotatable relative to said platform such that said stirrups are rotatable inward for supporting a user's legs when using the overhead creeper, and outward to allow the user to easily climb on and off the top platform without interference from said stirrups.

2. The overhead creeper as claimed in claim 1 further comprising a chin/head rest associated with said platform.

3. The overhead creeper as claimed in claim 2 wherein said platform includes casters.

4. The overhead creeper as claimed in claim 1 wherein said base includes adjustable lower leg members.

5. The overhead creeper as claimed in claim 1 wherein said ladder is adjustable.

6. The overhead creeper as claimed in claim 5 wherein a step of said ladder is adjustable in position.

* * * * *